United States Patent [19]

Rieple

[11] Patent Number: 4,986,292

[45] Date of Patent: Jan. 22, 1991

[54] BULK STORAGE AND HANDLING SYSTEM

[75] Inventor: Theodore R. Rieple, Farmington Hills

[73] Assignee: Diversey Corporation, Mississauga, Canada

[21] Appl. No.: 340,515

[22] Filed: Apr. 19, 1989

[51] Int. Cl.[5] ..... B65D 88/54

[52] U.S. Cl. ..... 134/166 R; 134/167 R; 137/348; 137/572; 141/231; 105/236; 220/855

[58] Field of Search ..... 220/855, 1 V; 141/231, 141/346; 134/166 R, 167 R; 137/559, 572, 348; 105/236, 215.1, 215.2, 396

[56] References Cited

U.S. PATENT DOCUMENTS

| | | | |
|---|---|---|---|
| 1,487,394 | 3/1924 | Lorenz | 105/236 |
| 1,542,116 | 6/1925 | Welcker | 137/572 |
| 1,741,618 | 12/1929 | Dudley | 105/236 |
| 1,994,815 | 3/1935 | Ferrin | 105/215.2 |
| 2,332,443 | 10/1943 | Foringer | 105/215.1 |
| 3,722,556 | 3/1973 | Jeffers et al. | 141/231 |
| 3,817,274 | 6/1974 | Anderson | 137/558 |
| 3,895,756 | 7/1975 | Jaeger | 134/167 R |
| 4,002,192 | 1/1977 | Mowatt-Larssen | 137/572 |
| 4,053,001 | 10/1977 | Healey et al. | 141/231 |
| 4,082,124 | 4/1978 | Jenkins | 141/231 |
| 4,174,740 | 11/1979 | Tobler | 141/231 |
| 4,344,467 | 8/1982 | Lahde | 141/231 |
| 4,415,369 | 11/1983 | Allmendinger et al. | 141/231 |
| 4,513,774 | 4/1985 | Reid | 137/559 |
| 4,547,107 | 10/1985 | Krause | 105/215.2 |
| 4,628,960 | 12/1986 | Brickell et al. | 137/559 |
| 4,665,956 | 5/1987 | Freeman | 141/231 |
| 4,793,386 | 11/1988 | Sloan | 141/231 |

*Primary Examiner*—Stephen Marcus
*Assistant Examiner*—S. Castellano
*Attorney, Agent, or Firm*—William D. Blackman; Arnold S. Weintraub

[57] ABSTRACT

The present invention includes a system for storing and transporting a liquid in which a series of tank cars each have a hollow tank body with an inlet and an outlet supported on a frame with a plurality of wheels on the frame. These cars are connected together with a sealable male fitting and female fitting which interengage to allow fluid flow between the cars. Using this valve arrangement, a series of cars hooked together may be filled from a single fill point or station. A method of storing and transporting a liquid involving these storage cars is also disclosed.

13 Claims, 2 Drawing Sheets

BULK STORAGE AND HANDLING SYSTEM

BACKGROUND OF THE INVENTION

1. Field of the Invention

The present invention relates to a system and method for bulk storage and transport of liquids in an industrial setting. More particularly, the present invention relates to such a system and method involving connectable and disconnectable storage cars which may be filled with a liquid through a single fill point when several of these cars are connected in series.

2. Prior Art

Bulk storage and transfer systems for use with liquids in industrial settings have several advantages such as cost savings, convenience, and ready accessibility. However, current in-plant bulk storage and transfer systems normally involve large tanks with limited or nonexistent mobility, and complicated and expensive piping systems to transfer the material stored in the tanks to points of use. Thus, flexibility of current systems is less than optimal.

Moreover, medium and smaller industrial companies are not always candidates for current bulk delivery systems due to their size. Yet, many such customers would like to take advantage of the safety, convenience, and cost savings that bulk delivery provides.

Portable reusable containers for liquids, sometimes referred to as "tote bins", are known and used today. However, these bins are expensive to return to a seller of the bulk liquid, and further costs are incurred to clean and to refill the currently used containers. In addition, these portable "tote bins" sometimes exceed the weight capacity of a forklift truck which is ordinarily used to move them about in a plant. Furthermore, the size of these portable tote bins is not standardized, and they must be weighed to determine the volume contained therein each time they are filled.

The use of 55-gallon drums is, also, common for the transport and storage of chemicals and the like. However, disposing of these drums once they are emptied of their contents is increasingly becoming a problem due to the current crisis in landfill space and the possibly hazardous nature of some contents of the drums. In view of this current crisis in land fill operations in the United States, particularly hazardous waste land fills and the like, it would be advantageous to minimize use of disposable 55-gallon drums.

Thus, it is to be appreciated that there exists a need for improved means and methods for storing and transport of bulk chemicals and other fluids within an industrial plant or the like. It is to this need that the present invention is directed.

SUMMARY OF THE INVENTION

The present invention provides a system and method for bulk storage and transport of liquids, such as chemicals or the like, within an industrial plant or complex. The system hereof is defined by a series of standard sized refillable and reusable storage cars. These cars are connectable to one another in series and can be placed in fluid communication with one another, when connected, so that an entire series of cars may be filled at a single fill point. Any single car, in accordance with the present invention, whether full or empty, may be lifted by a standard fork truck or otherwise transported to a point of use. Alternatively, one or more of these cars may be pulled behind a fork truck.

A tank or storage car, in accordance with the present invention, comprises:

(a) a hollow tank body having an inlet and at least one outlet, the tank body being fillable through the inlet;

(b) a support frame, the tank body being mounted on the frame;

(c) a male fitting attached to the tank body; and (d) a female fitting on the tank body in fluid communication with the inlet or the outlet and disposed substantially opposite the male fitting, the male fitting being sealably connectable to a female fitting of a substantially similar second car to allow fluid flow therebetween.

For a more complete understanding of the present invention, reference is made to the detailed description section, which should be read in conjunction with the accompanying drawings. Throughout the following description and in the drawings, identical reference numbers are used to refer to the same component shown in multiple figures of the drawings, in which:

BRIEF DESCRIPTION OF THE DRAWINGS

FIGS. 4A–4B are cross-sectional views of one embodiment of a male fitting engagable with a female fitting to serially connect two of the tank cars; wherein FIG. 4A shows the fittings disengaged, and FIG. 4B shows the fittings in an engaged configuration.

DETAILED DESCRIPTION OF THE PREFERRED EMBODIMENT

Figure 1:
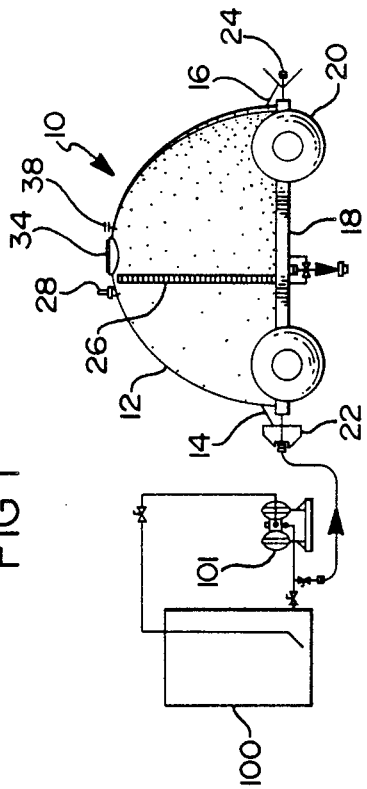
FIG. 1 is a side plan view, partially in schematic, of a refillable tank car and pumping system for use in the present invention.

Referring to FIG. 1, a refillable tank car 10 is shown having a hollow tank body 12, the tank body 12 having an inlet 14 and an outlet 16. The tank body 12 is a generally hemispherical hollow member having a flat floor 25 which is continuous therewith. The tank body 12 serves as a container for storing fluids therein for extended periods of time without the contents thereof being exposed to the air outside of the tank body 12. In view of the possibility of storing caustic materials therein such as acids or highly alkaline solutions, the tank body 12 is formed of a material which is resistant to erosion by such chemicals. Examples of suitable materials which may be used to form the tank body 12 include, e.g., molded fiberglass, impact-resistant plastics, and the like. The exact shape of the tank body 12 is not critical to the present invention. The tank car 10 is used for storing and transporting a liquid such as a chemical, a detergent, or other liquid primarily intended for use in industrial applications. However, it should be noted that the tank car may be used for transporting any liquid, slurry, suspension, or the like.

Figure 5:
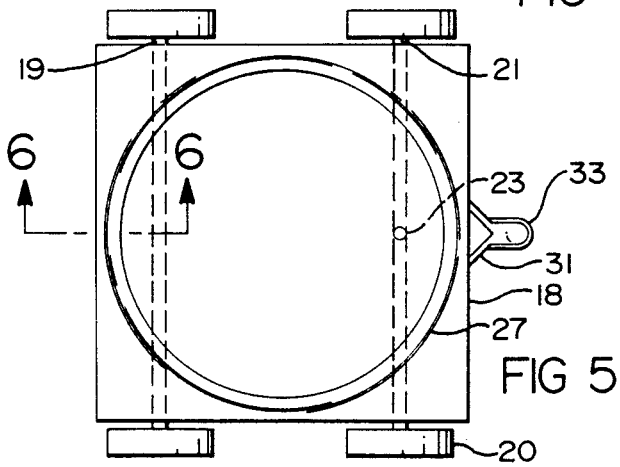
FIG. 5 is a top plan view of a tank car frame hereof.
Figure 6:
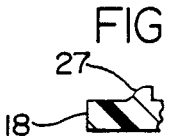
FIG. 6 is a partial cross-section through the frame of FIG. 5, taken along the line 6—6.

The tank body 12 is removably attached to a support frame 18 and a plurality of wheels 20 are rotatably attached to the frame 18. As seen in FIGS. 5–6, the frame 18 is a, generally, rectangular, planar member formed from any suitable material, such as steel or the like, which has sufficient structural rigidity to support a filled tank body 12 thereon. A pair of spaced apart axles 19, 21 traverse the frame and are each used to support a pair of wheels 20 thereon. At least one of the axles 19, 21 is mounted to the frame 18 by a swivel or pivot 23 to enable the car 10 to turn. Alternatively, the wheels 20 may be mounted directly to the frame 18.

Each axle helps to support the frame 18. In one embodiment, a circular ridge 27 is integrally formed with the frame 18, extends upwardly therefrom, and serves to align the tank body 12 with respect to the frame 18 and to retain the tank body 12 thereon.

As shown in the drawing, a male fitting 22 is attached to the front of the tank body 12 and is in fluid communication with the inlet 14 thereof. A female fitting 24 is located on the tank body 12 substantially opposite the male fitting 22. The male fitting 22 is sealably connectable to a female fitting 124 of a substantially similar car such as, e.g., a second tank car 40 shown in FIG. 3 to allow fluid flow therebetween, as subsequently detailed. The second tank car 40 includes a hollow tank body 112 having an inlet 114 and an outlet 116, the tank body 112 being mounted on a frame 118 having wheels 120 thereon, the second tank car 40 being substantially similar to the first tank car 10 in all respects except for capacity of the tank body 112.

In one embodiment, and as previously noted, the tank body 12 is formed as a unitary molded fiberglass or other impervious shell. When the tank body 12 is a fiberglass shell, this shell is fabricated to be resistant to corrosive chemicals such as, e.g., acid or alkaline. The capacity of the tank body 12 is preferably in a range from 100 gallons to 1,000 gallons. A particularly preferred capacity range is between 100 gallons and 300 gallons. The frame 18 and wheels 20 are also preferably formed of chemically resistant materials such as stainless steel, suitable polymers or elastomers, or graphite composite materials.

Figure 2:
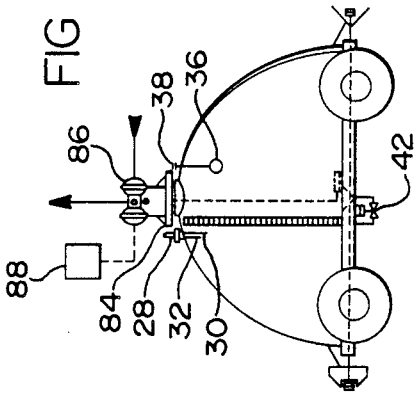
FIG. 2 is a schematic diagram of a second embodiment of a refillable tank in accordance with the present invention.

Two types of level sensors are incorporated into the tank car 10. A "sight glass" or visual level indicator 26 is, preferably, disposed vertically on the outside of the tank body 12 and is attached thereto. The indicator 26 is in fluid communication with the contents of the tank body 112 to enable visual inspection of the fluid level in the tank body 12. Secondly, an electronic full level sensor 28 as shown in FIG. 2 is disposed in the tank body 12, and preferably includes a low limit full level sensor 30 and a high limit full level sensor 32. The sensor 26 is in electronic communication with a vent in a cap on a hose fitting 38, the vent being electrically operated. When a car such as 10 is being filled, the vent remains open until the sensor 26 indicates that the tank 12 is full. Then the vent 38 is electronically closed.

A porthole or cover 34 is provided on the tank body 12 and may be opened for inspection, access, and maintenance purposes. In the embodiment shown, a conventional spray or shower head 36 is permanently disposed within the tank body 12 in fluid communication with a hose fitting 38 connectable to a fluid source (not shown) for use in cleaning the interior of the tank body 12. A drainage valve 42 is disposed at the bottom of the tank body 12 in fluid communication therewith. The drainage valve 42 may be used to meter out the contents of the tank body 12 and also may be used in conjuction with the spray head 36 for cleaning the interior of the tank body 12. In preferred embodiment of the present invention, a single tank car 10 is dimensioned and sized so as to be easily transportable, in either a full or empty condition, by a standard forklift truck.

For a high-volume industrial facility which has a bulk storage tank 100 on the premises, the tank car 10 may be used at a point where the contents thereof are needed, and then transported back to the storage tank 100 where a pump 101 may be used to refill the tank body 12 through the inlet 14. Once refilled, the tank car 10 is either pulled or carried by a forklift truck (not shown) back to the point of use.

Figure 4A:
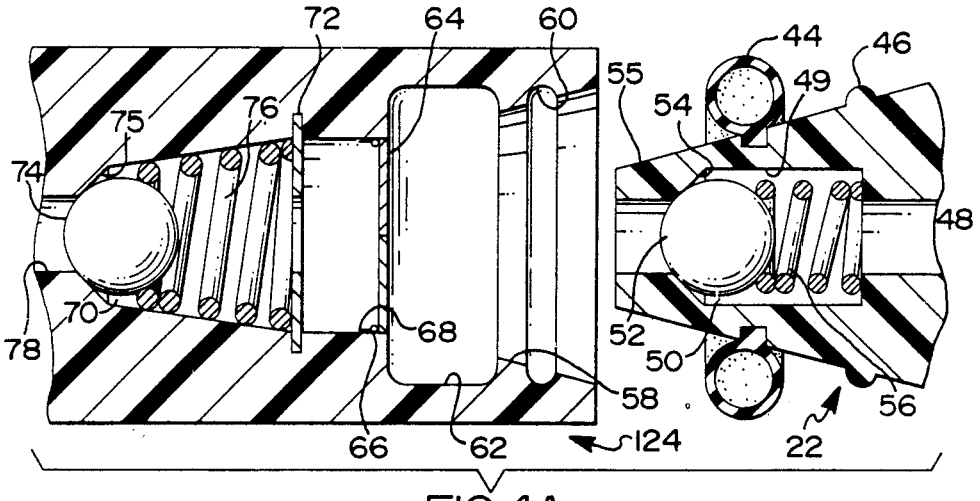
Figure 4B:
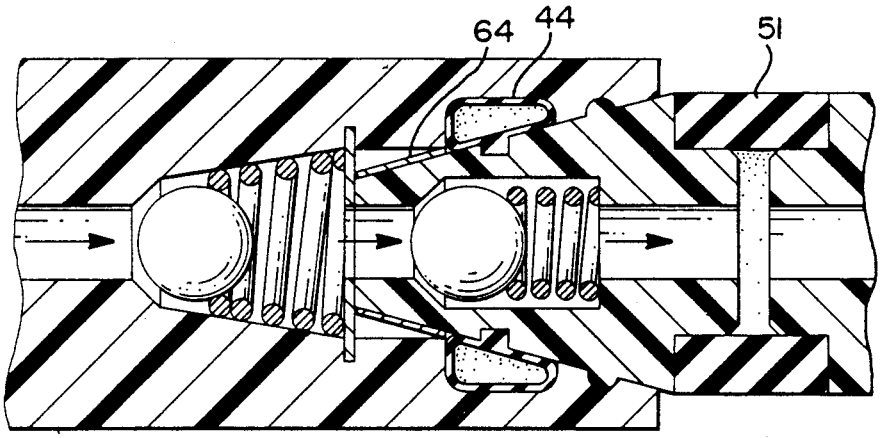

In order to achieve the purposes of the present invention it is incumbent that the cars be serially connectable to achieve filling thereof individually or simultaneously of one or more cars. FIGS. 4A and 4B disclose one embodiment for enabling multiple filling of serially connected cars.

As shown in FIGS. 4A–4B, a male fitting 22 is shown with a female fitting 124 in both an engaged and disengaged position. The male fitting 22 is substantially conical in shape, and has a circumferential sealing ring 44 therearound. The sealing ring 44 is formed from a deformable resilient compound such as rubber or an elastomeric material, and is hollow and inflatable to form a tight seal between the male fitting 22 and a female fitting such as shown at 124 to prevent leakage therepast. An alignment ridge 46 is also provided around the male fitting 22 which is alignable with a circumferential groove 60 in the female fitting 24. As shown in FIG. 4B, the male fitting 22 may include a flexible rubber section 51. Alternatively, the male fitting 22 may be attached to the tank body 12 by pivot pins at the top and bottom thereof and by a flexible hose connecting a fluid passage 48 thereof to the inlet 14 of the tank body 12. This flexible attachment of the male fitting 22 to the tank body 12 works in conjunction with the flexible attachments of the male fittings of other cars in a series or "train" of these cars to allow the train to turn corners when being pulled by a fork truck (not shown) or the like.

A hollow fluid passage 48 is formed within the male fitting 22 to allow fluid communication with the hollow interior of the tank body 12 through the inlet 14 thereof. Disposed within an enlarged portion of the passage 48 is a check ball 52 which is seated in a seat 54 by a spring 56, the spring 56 also being disposed within the enlarged portion 49 of the passage 48. The check ball 52, seat 54, and spring 56 thus provide a one way check valve 50 within the male fitting 22.

The female fitting 24 may be formed in the tank body 12 or may be attached thereto, and generally includes a substantially conical recess 58 formed therein. An enlarged toroidal groove 62 extends radially outwardly as part of the recess 58 and receives the sealing ring 44 therein as shown in FIG. 4B. A plurality of fluid-impervious doors or flaps 64 are disposed within the recess 58 forwardly of the toroidal groove 62. The doors 64 are attached to the female fitting 124 by hinges 66, and are biased toward a closed position as shown in FIG. 4A by springs 68. A check valve 70, is also, provided in the female fitting 124 to assure one way flow therethrough. The check valve 70 include a check ball 74 which is disposed in a seat 75 and is biased into the seat 75 by a spring 76 disposed within the recess 58. A retaining ring 72 is provided to retain the spring 76 in the recess 58. A passage 78 continues forwardly of the recess 58 to allow fluid communication between the female fitting 124 and the interior of the tank body 112. The inlet 14 and outlet 16 generally are in fluid communication with the interior of the tank body 10. A pressure-actuated vent valve may be provided in the cover 34 or proximate the top of the tank body 12 to allow pressure in the tank body 12 to be relieved to the atmosphere if it exceeds a specified level. Such a vent valve may be incorporated into a cap on the hose fitting 38 for the spray head 36.

Figure 3:
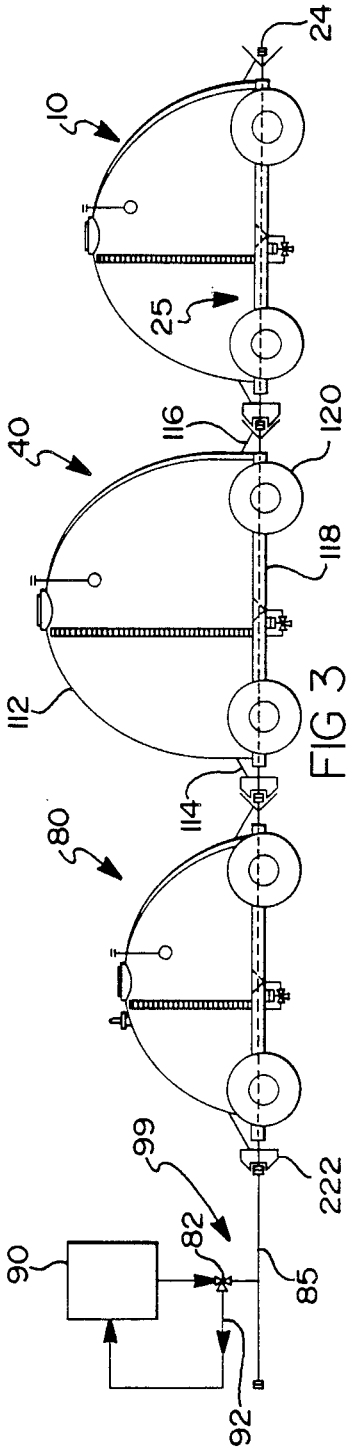
FIG. 3 is a schematic diagram of a bulk storage and transport system including a series of three serially connected refillable tank cars in accordance with the present invention.

When the male fitting 22 is inserted into a female fitting 124 of a second car such as that shown at 40 in FIG. 3, the front portion 55 of the male fitting 22 pushes against the force of the springs 68 to open the doors 64 of the female fitting 24. The sealing ring 44 is then pressurized, such as with compressed air from a compressed air source (not shown), to retain the male fitting 22 in the female fitting 24 and to form a pressure-tight seal therebetween. A number of tank cars in accordance with the present invention such as 10, 40, and 80 as shown in FIG. 3 may be connected together in a series; and a single fluid source, such as a commercial tank truck symbolized by the box 90 in FIG. 3 may be used to fill the cars 10, 40, 80 simultaneously. The cars 10, 40, 80 may all be filled in this way at a single point or fill station such as that shown at 99 in FIG. 3. When the cars are hooked together as described, a fluid supply line 85 from a fluid source 90 is attached to the male fitting 222 of the forwardmost car 80 and a flow control valve 82 is then opened. Fluid pressure from the fluid source 90 will successively disengage check valves similar to those shown at 70, 50 in each of the male and female fittings of the cars 10, 40, 80 until the fluid pressure pushes against the fluid-impervious doors 64 of the last car 10 in the sequence. The doors 64 are designed to withstand high pressure without allowing the passage of fluid therepast. Thus the series of cars may be filled without spillage out of the female fitting 24 of the last car 10 in the sequence. Of course, because the doors 64 are normally sealed, any one individual car may be filled without fluid spillage.

Referring now to FIG. 2, a shelf unit 84 for attachment thereto of optional hardware may be mounted to the tank body 12 adjacent the porthole 34, and a suitable pump 86 and control panel 88 may be mounted to the shelf unit 84. One skilled in the art will realize that other optional features may be added to the tank car 10 without departing from the scope of the present invention.

A removable yoke 31 may in one embodiment, be provided for attachment to the tank car frame 18 for use in transporting a train of serially connected tank cars. The front of such a yoke may include a socket section 33 of a conventional trailer hitch. The yoke may be attached to the frame 18 by pins, nuts and bolts, or other appropriate fasteners.

The tank cars of the present invention may be manufactured in various capacities, and cars of different capacities may be joined together in series as shown in FIG. 3. The fill system described herein allows for cars of different sizes and capacities to be filled from one fill source 90 at the same time. The fill interlock system on each car is the same and is located at a standard height from the ground on all cars. The fill interlock system of the male and female fittings as herein described easily connects together, regardless of the size or capacity of the cars which are being connected together. Each car fills to its designated capacity and shuts off automatically as the check valve as shown at 70 opens and the other cars continue to fill. It would be within the scope of the present invention for five 250 gallon cars, one 100 gallon car, and two 500 gallon cars to be joined together in a train and to be filled at the same time.

The present invention also encompasses a system of bulk storage and transport of liquids, which includes a fluid return loop in communication with the fill valve 82 of the present invention, whereby when the pressure in the line 85 reaches a certain level because all the cars 10, 40 80 are filled, fluid from the fluid source 90 will no longer enter the system of the cars, but will be diverted back to the fluid source 90. A system for storing and transporting a liquid in accordance with the present invention is generally illustrated in FIG. 3.

The system of the present invention also includes a fill station 99, comprising a fill valve 82 for directing a flow of a liquid;

an overflow line 92 in fluid communication with the fill valve 82, the overflow line 92 connectable to a liquid source 90; and means for connecting the fill valve 82 to an inlet of a tank car. The means for connecting the fill valve 82 to an inlet of a tank car may be a fluid line 85 and connector as shown in FIG. 3.

It should be noted that another possible means for connecting the first tank body 12 to the second tank body 112 to allow fluid flow therebetween could be a conventional high-pressure hose and quick-disconnect compression fitting arrangement as will be appreciated by those skilled in the art. In this embodiment, a simple mechanical linkage such as that used to connect commercial railroad cars could be provided between the cars 10, 40.

Although the present invention has been described herein with respect to specific embodiments, it will be understood that the foregoing description is intended to be illustrative and not restrictive. Many modifications of the present invention will occur to those skilled in the art. All such modifications which fall within the scope of the appended claims are intended to be within the scope and spirit of the present invention.

Having, thus, described the invention, what is claimed is:

1. A tank car for storing and transporting a fluid, comprising:

(a) a hollow tank body having an inlet and an outlet, the tank body being fillable through the inlet;

(b) a support frame having a plurality of wheels for movement thereof, the tank body being mounted on the frame;

(c) a male fitting attached to the tank body;

(d) a female fitting on the tank body in fluid communication with the inlet or the outlet and disposed substantially opposite the male fitting, the male fitting being sealingly connectable to a female fitting of a substantially similar second car to allow fluid flow therebetween; and (e) means for limiting fluid flow between tank cars to a single direction.

2. The tank car of claim 1, wherein the tank body is formed of a chemically impervious material.

3. The tank car of claim 1, wherein the frame and wheels are formed of chemically resistant materials.

4. The tank car of claim 1, further comprising a level sensor to indicate a fluid level in the tank.

5. The tank car of claim 4, wherein the level sensor comprises a visual level indicator disposed outside of the tank body and attached thereto.

6. The tank car of claim 1, further comprising a spray head disposed inside the tank and connectable to a fluid source for cleaning the tank body.

7. The tank car of claim 6, further comprising a drainage valve disposed proximate the bottom of the tank body for draining fluid therefore.

8. The tank car of claim 1 further comprising: means for detachably connecting the body to the frame.

9. The tank car of claim 1, wherein the flow limiting means comprises:

(a) a fluid passage in the female fitting, the passage defining a seat;

(b) a check ball which fits sealingly in the seat, and (c) means for normally biasing the check ball into the seat.

10. The tank car of claim 1, wherein the tank body has a capacity in a range from 100 gallons to 1000 gallons.

11. The tank car of claim 1, wherein the male fitting has a substantially conical end portion.

12. The tank car of claim 1, wherein the tank car is dimensioned so as to be transportable by a forklift.

13. The tank car of claim 1, wherein the frame further comprises an integral retaining ridge for aligning the tank body with respect to the frame.

* * * * *